United States Patent [19]

Sarvanne

[11] 4,389,159

[45] Jun. 21, 1983

[54] CENTRIFUGAL PUMP

[75] Inventor: Hannu Sarvanne, Vantaa, Finland

[73] Assignee: Oy E. Sarlin AB, Helsinki, Finland

[21] Appl. No.: 210,361

[22] Filed: Nov. 25, 1980

[30] Foreign Application Priority Data

Nov. 29, 1979 [FI] Finland ..... 793738

[51] Int. Cl.[3] ..... F04D 17/08; F04D 29/46

[52] U.S. Cl. ..... 415/219 A; 415/206; 415/207; 415/219 C

[58] Field of Search ..... 415/204, 206, 207, 203, 415/219 R, 219 A, 219 B, 219 C

[56] References Cited

U.S. PATENT DOCUMENTS 3,824,028 7/1974 Zenkner et al. ..... 415/219 C X

FOREIGN PATENT DOCUMENTS 1428080 11/1968 Fed. Rep. of Germany ..... 415/206

2705329 8/1978 Fed. Rep. of Germany ..... 415/207

*Primary Examiner*—Philip R. Coe
*Assistant Examiner*—Timothy F. Simone
*Attorney, Agent, or Firm*—Martin Smolowitz

[57] ABSTRACT

A centrifugal pump with a housing which has circular shape in the direction of the circumference and which has on its circumference an exit tube commencing at an exit port tangentially with reference to the flow, where the length of the exit port in the direction of the housing's circumference is about $\pi/4R$ and where the outer wall of the exit tube constitutes a diverging bulge on outward transition from the circumference. The outer wall of the exit tube, projecting under an angle about 45 degrees from the circumference of the housing, consists of an arc having the center of its radius (r) approximately at the juncture of the opposite wall of the exit tube and the housing circumference.

2 Claims, 2 Drawing Figures

CENTRIFUGAL PUMP

BACKGROUND OF THE INVENTION

The present invention concerns a centrifugal pump of which the housing has circular shape in the circumferential direction and which has on its circumference an exit tube commencing at an exit port tangentially with reference to the flow, and wherein the length of the exit port in circumferential direction of the housing is about $\pi/4R$ and where the outer wall of the exit tube forms a diverging bulge on transition outward from the circumference of the housing.

Centrifugal pumps of similar type are used, for instance, in sewage pumping installations. Such cases are encountered in practice in which from the sewage pump is required a great lifting height but low volumetric flow rating. Since the sewage pump is required to have a high enough so-called transmitting capacity which enables even large solids to pass through the pump, the designing of such pumps has been nearly impossible owing to the fact that it becomes unavoidable, in consideration of the transmitting capacity, to make the outflow cross section of the pump housing altogether too large from the flow technology point of view. In order that the centrifugal pump could be induced to deliver a great lifting height, the velocity of the liquid after the impeller must also be high. Low volumetric flow rate implies that the average velocity through the outflow cross section is very low, that is merely a fraction of the velocity adjacent to the impeller, whereby in a housing of conventional design a large proportion of the flow is forced to return into the housing, under the tongue. Hereby a back flow into the housing is created which gives rise to vortex losses and acts as a brake on the liquid velocity adjacent to the impeller.

DESCRIPTION OF THE INVENTION

The object of the present invention is to provide a centrifugal pump which eliminates the drawbacks mentioned above. The centrifugal pump of the invention is characterized in that the outer wall, projecting from the circumference of the housing under an angle about 45 degrees, of the exit tube consists of an arc having the centre of its radius approximately at the juncture of the opposite wall and the circumference of the housing.

In the pump of the invention, the harmful flow described above fails to materialize because the flow is by the aid of the shape of the housing and exit tube directed in such manner that into the exit port flows a smaller liquid quantity, which is equivalent to the mean velocity of the liquid in the exit tube, whereby the vortex losses mentioned are not incurred and the liquid velocity adjacent to the impeller is allowed to evolve freely. This implies increased lifting height and improved efficiency. Trials that have been made have demonstrated that both the lifting height and the efficiency were augmented by about 20–30% in a pump constructed according to the invention.

Figure 1:
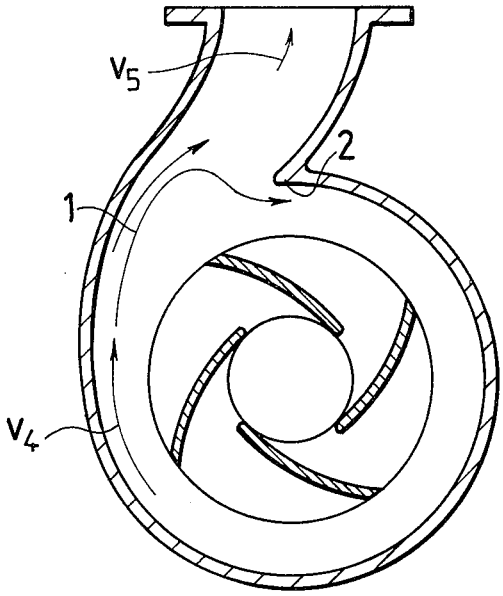

The invention is described in the following with the aid of an example, with reference to the attached drawing, wherein:

FIG. 1 shows a cross-sectional view of a conventional centrifugal pump.

Figure 2:
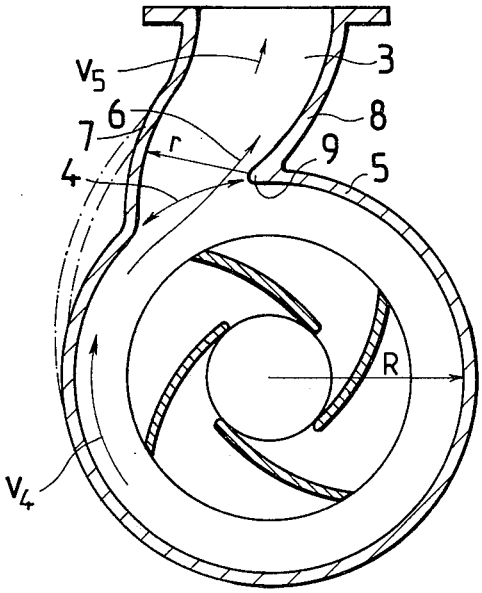

FIG. 2 presents a cross-sectional of a centrifugal pump of the invention.

In conventional centrifugal pumps, the outflow cross section of the pump housing has been made altogether too large as judged by flow technological considerations, in view of the pump transmittance capacity. In order that a great lifting height of the centrifugal pump might be attained, the liquid velocity $v_4$ after the impeller also has to be high so that sufficient centrifugal force is generated. Low volumetric flow rate implies that the mean velocity $v_5$ mean in the outflow cross section is very low, that is only a fraction of velocity $v_4$, whereby in a conventionally designed housing a substantial part of the flow must return as shown by the arrow 1, back into the housing under the tongue 2. This back flow introduces vortex losses and acts as a brake on the velocity $v_4$.

In the centrifugal pump of FIG. 2, the length 4 of the exit port of the exit tube 3 in the direction of the periphery 5 of the housing is about $\pi/4R$, where R is the inner radius of the pump housing. The walls of the exit tube 3 constitute a diverging bulge on transition outwardly from the periphery 5 of the housing.

The outer wall 7 of the exit tube, projecting from the circumference 5 of the housing under an angle about 45 degrees, consists of an arc which has the centre of its radius r approximately at the juncture of the opposite wall 8 and the circumference 5 of the housing, that is at the tongue, point 9.

The pump of the invention is free of the detrimental flow 1 explained, because by means of the shape of housing 5 and exit tube 3 the flow is given the direction indicated by the arrow 6 so that a smaller liquid quantity enters the exit port, that is one which is consistant with the mean velocity $v_5$ mean of the liquid, whereby the said vortex losses do not materialize and the velocity $v_4$ of the liquid may develop freely. This implies improved lifting height and efficiency of the pump.

I claim:

1. A centrifugal pump with a housing which has circular shape in the direction of the circumference and which has on its circumference an exit tube commencing at an exit port substantially tangential with reference to the flow, where the length of the exit port in the direction of the housing circumference is about $\pi/4$ times the inner radius of said housing and where the outer wall of the exit tube constitutes a diverging bulge on outward transition from the circumference, and wherein the outer wall of the exit tube, projecting under an angle about 45 degrees from the circumference of the housing, consists of an arc having the centre of its radius approximately at the juncture of the opposite wall of the exit tube and the housing circumference.

2. The centrifugal pump of claim 1, wherein the mean velocity in the exit tube is substantially less than that in the pump housing.

* * * * *